US006523331B1

(12) United States Patent
Fresnel

(10) Patent No.: US 6,523,331 B1
(45) Date of Patent: Feb. 25, 2003

(54) MACHINE FOR SETTING HEAT-SHRINKABLE SLEEVES ON OBJECTS FROM A CONTINUOUS SHEATH

(75) Inventor: Eric Fresnel, Paris (FR)

(73) Assignee: Sleever International Company, Morangis (FR)

( * ) Notice: Subject to any disclaimer, the term of this patent is extended or adjusted under 35 U.S.C. 154(b) by 0 days.

(21) Appl. No.: 09/554,668

(22) PCT Filed: Dec. 8, 1998

(86) PCT No.: PCT/FR98/02656

§ 371 (c)(1),
(2), (4) Date: May 18, 2000

(87) PCT Pub. No.: WO99/30970

PCT Pub. Date: Jun. 24, 1999

(30) Foreign Application Priority Data

Dec. 12, 1997 (FR) ..... 97 15784

(51) Int. Cl.[7] ..... B65B 53/02

(52) U.S. Cl. ..... 53/557; 53/567; 53/585; 53/296; 493/273; 493/288

(58) Field of Search ..... 53/557, 585, 567, 53/291, 296, 298; 493/271, 273, 287, 288

(56) References Cited

U.S. PATENT DOCUMENTS 3,594,975 A * 7/1971 Abrecht ..... 53/291
3,792,807 A 2/1974 Mare et al.
3,910,013 A 10/1975 Babineau
4,600,371 A * 7/1986 Fresnel ..... 29/282
4,765,121 A * 8/1988 Konstantin et al. ..... 53/442
4,806,187 A * 2/1989 Fujisawa ..... 156/521
4,922,683 A * 5/1990 Connolly ..... 53/291

FOREIGN PATENT DOCUMENTS

| | | |
|---|---|---|
| EP | 0 368 663 | 5/1990 |
| FR | 2 016 240 | 6/1971 |
| FR | 2 738 797 | 3/1997 |

* cited by examiner

*Primary Examiner*—Rinaldi I. Rada
*Assistant Examiner*—Thanh Truong
(74) *Attorney, Agent, or Firm*—Nixon Peabody LLP; Stuart J. Friedman

(57) ABSTRACT

The invention relates to a machine for fitting sleeves of heat-shrink plastics material on objects, the sleeves being taken from a continuous sheath that is rolled flat. In the invention, a horizontal shaping mandrel (40) is provided that comprises two torpedoes (41, 42) in axial alignment and interconnected by a thread-like central element (43), the two torpedoes having facing ends (45, 46) each with a pair of smooth chamfers, and each torpedo resting freely on an associated V support (60). The sheath drive means comprises two adjacent pinch wheels (25, 26) disposed symmetrically on either side of the thread-like element (43) between the two V-supports (60) and passing in the vicinity of the pairs of smooth chamfers of the torpedoes (41, 42), each wheel (25, 26) having a peripheral groove (65, 66) that is complementary to the groove of the other wheel so as to form a horizontal axis passage for said thread-like element.

13 Claims, 6 Drawing Sheets

MACHINE FOR SETTING HEAT-SHRINKABLE SLEEVES ON OBJECTS FROM A CONTINUOUS SHEATH

FIELD OF THE INVENTION

The present invention relates to a machine for fitting heat-shrink plastics material sleeves on objects, in particular elongate objects of small section, the sleeves being taken from a continuous sheath that is rolled up flat.

BACKGROUND OF THE INVENTION

In a technique that is conventionally used in this field, this type of machine for fitting sleeves has a shaping mandrel over which the sheath is passed in order to open it, sheath drive means using motor-driven wheels which co-operate with an associated portion of the shaping mandrel to fit the open end of the sheath on an object, and cutter means that act between the shaping mandrel and the object to form a sleeve that is associated with said object.

Thus, over the last score or so years, a concept has been developed of shaping mandrels that are mounted floating and that extend vertically. On this topic, reference can be made to the following documents: FR-A-2 490 590, U.S. Pat. Nos. 3,792,807, 3,910,013, 4,016,704, 4,600,371, GB-A-1 430 090, and EP-A-0 109 105.

To transfer the sheath continuously around the shaping mandrel, the machines described in the above-specified documents use motor-driven presser wheels co-operating with backing wheels carried by the shaping mandrel, with the sheath that surrounds the shaping mandrel while traveling along it being clamped between the motor-driven presser wheels and the backing wheels which are mounted idle on axles associated with the mandrel. Those techniques are now thoroughly understood and in widespread use for fitting sleeves on objects such as flasks, bottles, and other containers.

Nevertheless, if it is desired to use sheaths of small diameter for putting on objects that are fine and elongate, i.e. sheaths of a diameter considerably smaller than 20 mm, the above technique using backing wheels mounted idle on the shaping mandrel becomes impractical. It is not possible to envisage mounting backing wheels on a shaping mandrel of diameter significantly smaller than 20 mm since such backing wheels would then be very small in diameter which would require them to rotate at very high speeds of rotation as the sheath travels along the shaping mandrel, and that would give rise to phenomena of wear and overheating that are incompatible with reasonable use on an industrial scale.

Proposals have also been made to organize the travel of the sheath over a shaping mandrel by pinching the sheath between two motor-driven wheels at an intermediate opening in the shaping mandrel.

Thus, document JP-A-1 410 808 discloses a floating mandrel type shaper having, in addition to an arrangement of wheels and idle backing wheels, a central window in which two motor-driven wheels pinch the walls of the sheath. However, the floating mandrel continues to be supported by the wheels and the backing wheels provided further up the shaper. Using the same approach, document U.S. Pat. No. 2,765,607 illustrates a floating mandrel which is constituted by two portions interconnected by side rods, with a central gap being formed in which the motor-driven drive rollers pinch the walls of the sheath. The floating mandrel is then supported by a rounded surface of the flattened top portion (which also forms an insertion spatula) bearing against the two motor-driven rollers. The bottom portion having a circular base then serves as a shaper and as a counterweight. Reference can also be made to document FR-A-2 738 797 which shows a shaper having two torpedoes interconnected by a plate where the sheath is pressed by driven wheels, or indeed to document EP-A-0 368 663 which shows a shaper having two floating mandrels, one of which is flat with a window (through which the sheath is pinched by drive wheels), while the other is torpedo-shaped, and disposed downstream from the cutter device.

In a variant, as shown in document FR-A-2 061 240, proposals have also been made to use a vertical shaper made up of two torpedoes interconnected by a rod, with drive wheels that pinch the flattened sheath in the vicinity of the rod, and with contact via four idle wheels being provided on each of the torpedoes. In that case also, the use of bearing wheels prevents the use of sheaths of small diameter.

Finally, the shaping mandrels shown in the above-mentioned documents do not really serve to solve the problem of transferring sheaths of very small diameter since inevitable phenomena of overheating and wear arise, which phenomena run the risk of damaging or even tearing the continuous sheath while it is being transferred over the mandrel. This is particularly true when it is desired to use such a machine at high rates of throughput, e.g. one hundred to two hundred sleeves fitted per minute. A sheath of diameter lying in the range 5 mm to 20 mm gives rise to a flat ribbon of narrow width (8 mm to 31 mm), and the flat ribbon is then relatively rigid and difficult to pull. The high mechanical strength gives rise to high forces that need to be overcome, from which the above-mentioned phenomena of overheating and wear arise. In addition, when rates of throughput are high, the positions of objects traveling beneath the shaper need to be controlled by using clamps or the like, thereby further complicating the structure of the fitting machine.

In general, the above-described techniques do not genuinely make it possible to optimize expanding the sheath while accurately controlling the section of the sheath as it leaves the shaping mandrel to engage on the object concerned. This makes it necessary to provide sheaths of diameter that is considerably greater than that of the objects they are to cover. Consequently, it is not possible to control the position of the sleeve in satisfactory manner, either axially or transversely. This becomes particularly critical when the sleeve is to be shrunk onto the object, in so far as the sleeve can be poorly positioned on the object and in any event shrinking needs to be that much greater. The person skilled in the art is well aware of the difficulties encountered under such circumstances, and in particular concerning attempts to control the position and the shrinking of the sleeve, above all when such a sleeve has printed wording and/or decoration thereon.

SUMMARY OF THE INVENTION

The invention seeks specifically to resolve that problem by designing a sleeve-fitting machine that gives higher performance while avoiding the above-mentioned drawbacks.

Thus, the object of the invention is to design a machine for fitting sleeves of heat-shrink plastics material on objects starting from a continuous sheath that is rolled up flat, the machine being entirely compatible with sheaths of small diameter, e.g. diameters lying in the range 5 mm to 20 mm, while nevertheless being capable of operating at high rates of throughput, i.e. considerably exceeding 200 sleeves fitted per minute, with the positions of the sleeves as fitted on the objects nevertheless being properly controlled.

According to the invention, this problem is resolved by a machine for fitting sleeves of heat-shrink plastics material on objects, the sleeves being taken from a continuous sheath that is rolled up flat, the machine including a shaping mandrel over which the sheath passes in order to be expanded, sheath drive means using motor-driven wheels which co-operate with an associated portion of the shaping mandrel to engage the open end of the sheath on an object, and cutter means intervening between the shaping mandrel and the object so as to form a sleeve associated with said object, the shaping mandrel being substantially horizontal and comprising two torpedoes in axial alignment interconnected by a thread-like central element, with an upstream torpedo having an upstream end forming an insertion spatula and a downstream end with a pair of smooth chamfers, and a downstream torpedo presenting an upstream end with a pair of smooth chamfers and a downstream end with a straight edge adjacent to the cutter means, each torpedo of said mandrel resting freely in an associated V-support, and the sheath drive means comprising, between the two V-supports, two adjacent pinch wheels disposed symmetrically on either side of the thread-like element of the shaping mandrel and passing in the vicinity of the chamfered smooth edges of the torpedoes, each wheel having a peripheral groove complementary to that of the other wheel so as to form a horizontal axis passage for said thread-like element.

By means of such an arrangement of two horizontal torpedoes interconnected by a thread-like central element, with the smooth double-chamfer ends thereof being free from bearing wheels, it is possible to organize the opening and rapid transfer of continuous sheaths of very small diameter. In addition, horizontal transfer makes it considerably easier to control the positions of the objects, even at high rates of throughput, e.g. by using sprocket-wheels.

It should be observed that the floating mandrel techniques described in the above-cited documents would be completely impractical for transferring a sheath horizontally.

Preferably, the insertion spatula of the upstream torpedo extends in a plane which is substantially perpendicular to the plane in which the continuous sheath is pinched between the two wheels. This makes it possible to shape the sheath around the mandrel which confers an ace-of-diamonds shape to the section of said sheath on leaving a shaping mandrel whose downstream torpedo is of substantially circular section, said shape being favorable both for transferring the sheath gently onto a cylindrical object, and for ensuring that the sheath is cut cleanly and without creasing downstream from the shaping mandrel. Naturally, it is possible to provide special shapes for the outlet section of the downstream torpedo in order to preform the sheath in ways that are adapted to the section of the object concerned.

Advantageously, the upstream torpedo and/or the downstream torpedo has two plane side facets substantially perpendicular to the plane in which the continuous sheath is pinched between the two wheels. These plane side facets decrease the side friction between the sheath and the torpedoes of the shaping mandrel, which is particularly favorable when said sheath carries a deposit of varnish or of some other material on its inside wall.

Preferably, the thread-like element is a flexible wire anchored at both ends in the torpedoes, one of the anchored ends being releasable so as to enable the length of said thread-like element between said torpedoes to be adjusted. For example, the thread-like element can be constituted by a steel wire having a diameter of about 1 mm.

Also preferably, the pairs of smooth chamfers of the upstream and downstream torpedoes are formed by sloping plane facets disposed symmetrically about a midplane containing the thread-like element and tangential to the two pinch wheels.

In particular, the pair of smooth chamfers of the upstream torpedo is formed by two plane facets sloping at about 30°, and the two pinch wheels pass tangentially over said pair of smooth chamfers, while the pair of smooth chamfers of the downstream torpedo is formed by two plane facets that slope at a smaller angle. It is also possible to provide for the pair of smooth chamfers to be defined by two fitted inserts, that are preferably interchangeable, having free facets constituting the sloping plane facets that co-operate with the pinch wheels.

A longitudinal slot can also be provided at the bottom of the V-groove of each torpedo support: such a slot makes it easier to pass the bottom fold of the sheath and avoids crumpling it.

According to another advantageous characteristic, the cutter means comprise a blade carried by a rotary arm on a horizontal axis, and said means is positioned in such a manner that its blade is flush with the straight edge of the downstream end of the downstream torpedo.

It is then preferable for the cutter blade to have two rectilinear cutting edges that meet at a leading edge and for the two cutting edges to be substantially perpendicular and arranged in such a manner that the leading edge meets the top of the sheath in the vicinity of a crease therein that results from said sheath passing over the insertion spatula or between the two pinch wheels.

The cutter means organized in this way makes it possible to obtain a perfectly clean cut that is made progressively, without folding the sheath, and in a very short length of time.

According to another advantageous characteristic of the invention, the two pinch wheels are peripherally coated in elastomer, and come into contact with each other on either side of their peripheral grooves which are trapezoidally shaped and present two facets sloping symmetrically about their midplane, forming a V that opens at an angle of about 60°, and the two pinch wheels are chamfered on their outer edges.

Advantageously, the two pinch wheels are mounted on a carrying structure capable of pivoting, preferably about a vertical axis, so as to enable the drive means as a whole to be offset laterally. It then becomes easy to take action quickly for cleaning or for the purpose of changing sheath format.

BRIEF DESCRIPTION OF THE DRAWINGS

Other characteristics and advantages of the invention will appear more clearly in the light of the following description and the accompanying drawings, relating to a particular embodiment, and with reference to the figures, in which.

DESCRIPTION OF THE PREFERRED EMBODIMENTS

Figure 1:
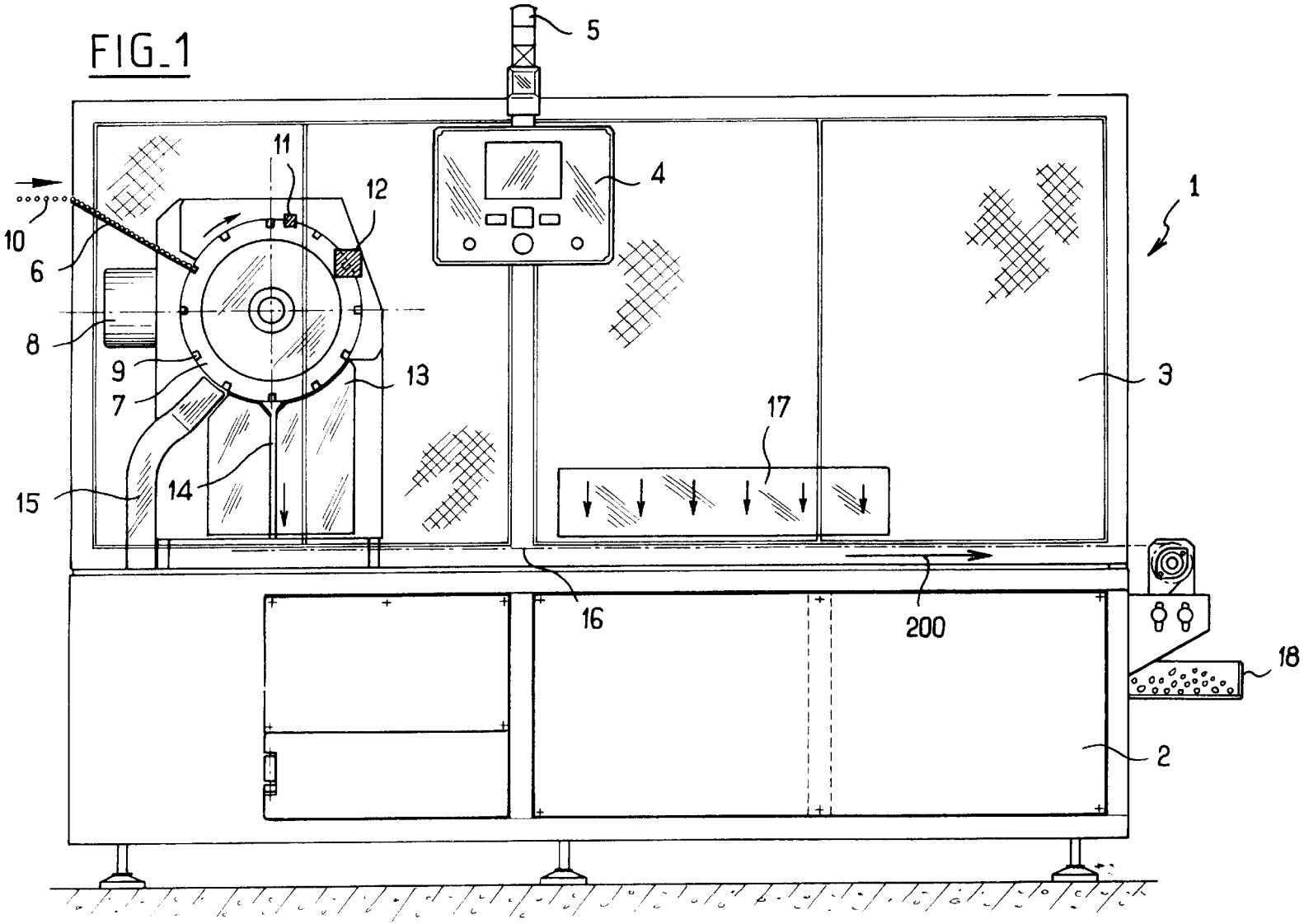
FIGS. 1 and 2 are a front view and a side view of a machine of the invention for fitting sleeves, said machine also being provided with a shrinking tunnel so as to constitute a unitary machine.
Figure 2:
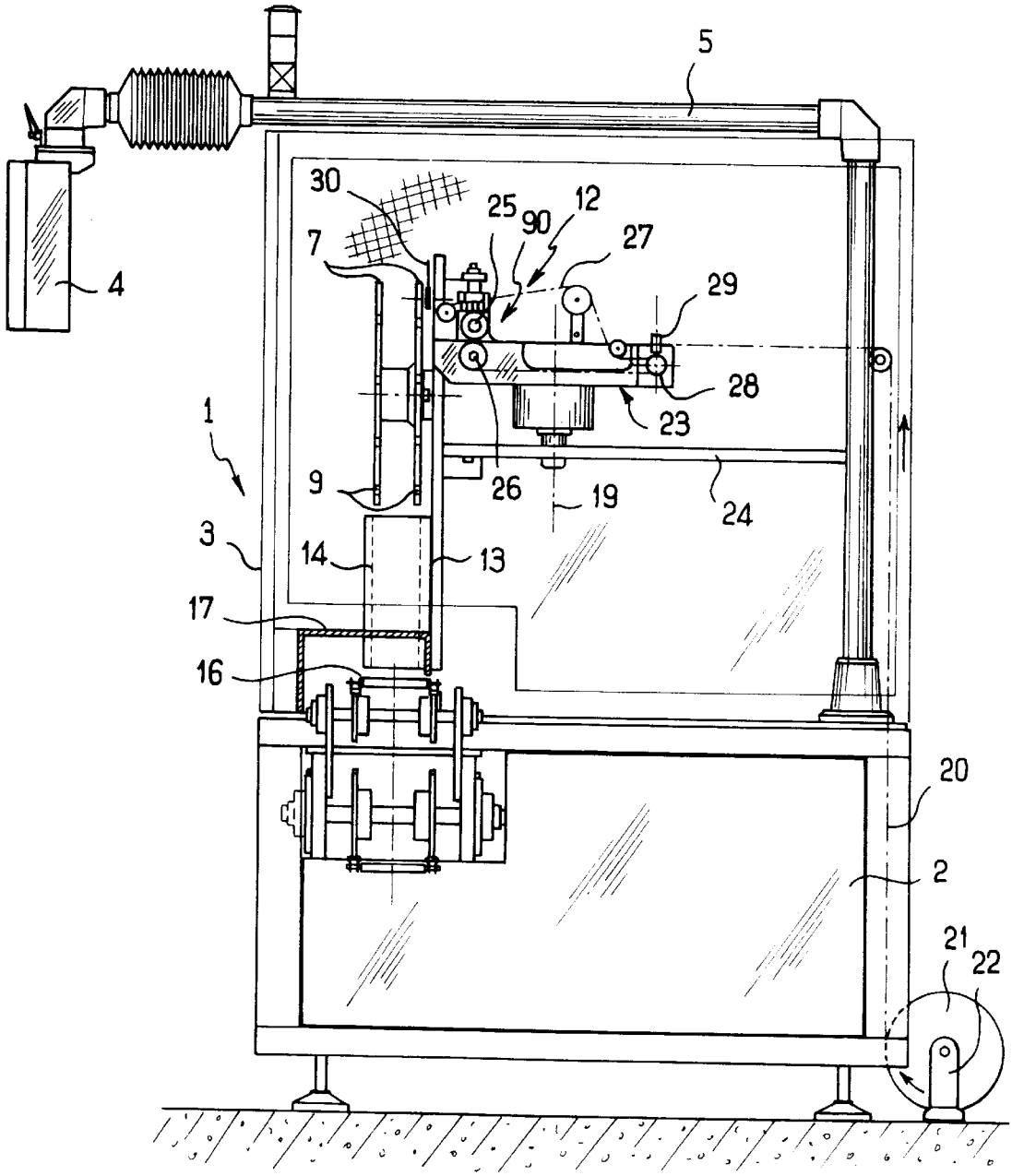

FIGS. 1 and 2 show a machine 1 for fitting sleeves of heat-shrink plastics material on objects, the material being taken from a continuous sheath that is rolled flat, and the machine being organized in accordance with the invention.

The machine comprises a main stand 2 carrying a glazed compartment 3 in which there are located all of the mechanical members for feeding objects, and also for horizontally transferring a continuous sheath that is rolled up flat, with the sheath being advanced progressively so as to wrap each individual object, and with the sheath being cut so as to form sheath segments or "sleeves". A control unit 4 supported on a pivoting bracket 5 enables the operator to monitor the various parameters of the sleeve-fitting machine, and optionally to modify certain adjustments of the operating cycle.

The elongate objects 10, e.g. pens for drawing, arrive via a feed hopper 6 which delivers them to a dual sprocket-wheel 7 rotated by a motor 8, the dual sprocket-wheel having peripheral slots 9 suitable for supporting each elongate object 10 at two locations. An object received in two aligned slots 9 of the dual sprocket-wheel 7 then progresses because the dual sprocket-wheel is rotating, until it reaches a station 11 for monitoring that an object is indeed present (with this function being performed by means of an optical sensor, for example), after which it reaches a station 12 which is the fundamental station for advancing the sheath and cutting off a length thereof so as to define a segment of sheath or sleeve that covers the object 10. The object 10 covered in its sleeve then continues its circular path until it reaches a bottom guide 13 which prevents it from falling away, after which it is delivered to an outlet chute 14, organized immediately below the axis of the dual sprocket-wheel 7 in this case, with the sleeved object then dropping onto a conveyor 16 which travels horizontally as represented by arrow 200. Any objects found to be defective, i.e. having a poorly positioned sleeve, are expelled via an evacuation chute 15. The objects 10 inside their sleeves as deposited onto the conveyor 16 then pass individually through a shrinking tunnel 17 fitted with heater elements (not shown), e.g. infrared heater elements, for the purpose of shrinking each sleeve on the associated object. On leaving the machine, the objects coated in their shrunk sleeves are recovered in a hopper 18.

FIG. 2 shows more clearly a continuous sheath 20 rolled up flat to form a supply reel 21 mounted on a fixed support 22, with the sheath being delivered from the reel by passing over various rollers until it comes level with a station 12 for transferring the sheath horizontally. The sheath is driven by sheath drive means 90 having two motor-driven wheels 25 and 26, themselves driven via a belt 27 passing over the outlet shaft of a drive motor 28. As explained below, the sheath is then clamped between the two wheels 25 and 26 between two torpedoes that constitute the horizontal shaping mandrel. The sheath reaches the transfer station 12 after passing between two guide rollers 29, in this case having vertical axes, while the sheath is still in its flat position, with the section of the sheath then extending in a plane that is substantially vertical. Cutter means 30, described in greater detail below, are organized at the outlet from the transfer station 12, in the vicinity of the dual sprocket-wheel 7 so as to cut off the end of the sheath that is engaged on an object, thereby defining a sheath segment or "sleeve".

In this case, the sheath drive means 90 and its two motor-driven wheels 25 and 26 are mounted on a load-carrying structure 23 organized in the form of a turret secured to a fixed cross-member 24, and capable of pivoting about a vertical axis 19. Such a pivoting configuration enables the drive means 90 as a whole to be offset laterally. This is most advantageous in practice since it enables an operator to take action quickly and easily via the access thus released to the components of the drive means in order to perform a cleaning or maintenance operation, or indeed in order to change the format of the sheath. Once the operation has been performed, the operator returns the moving equipment to its operating position and the assembly returns directly to its position where it is in alignment with the object. In addition to making it possible for intervention to take place quickly, this pivoting mount enables the drive means of the fitting machine to be implemented in highly compact form.

There follows a description in greater detail of the organization of the horizontal shaping mandrel and the two associated pinch wheels, described with reference to FIGS. 3 to 12.

As in the prior art, the fitting machine has a shaping mandrel over which the sheath is passed in order to expand it, drive means for driving the sheath by means of motor-driven wheels which co-operate with an associated portion of the shaping mandrel in order to engage the open end of the sheath on an object, and cutter means that act between the shaping mandrel and the object-supporting sprocket-wheels in order to form a sleeve associated with said object.

Figure 3:
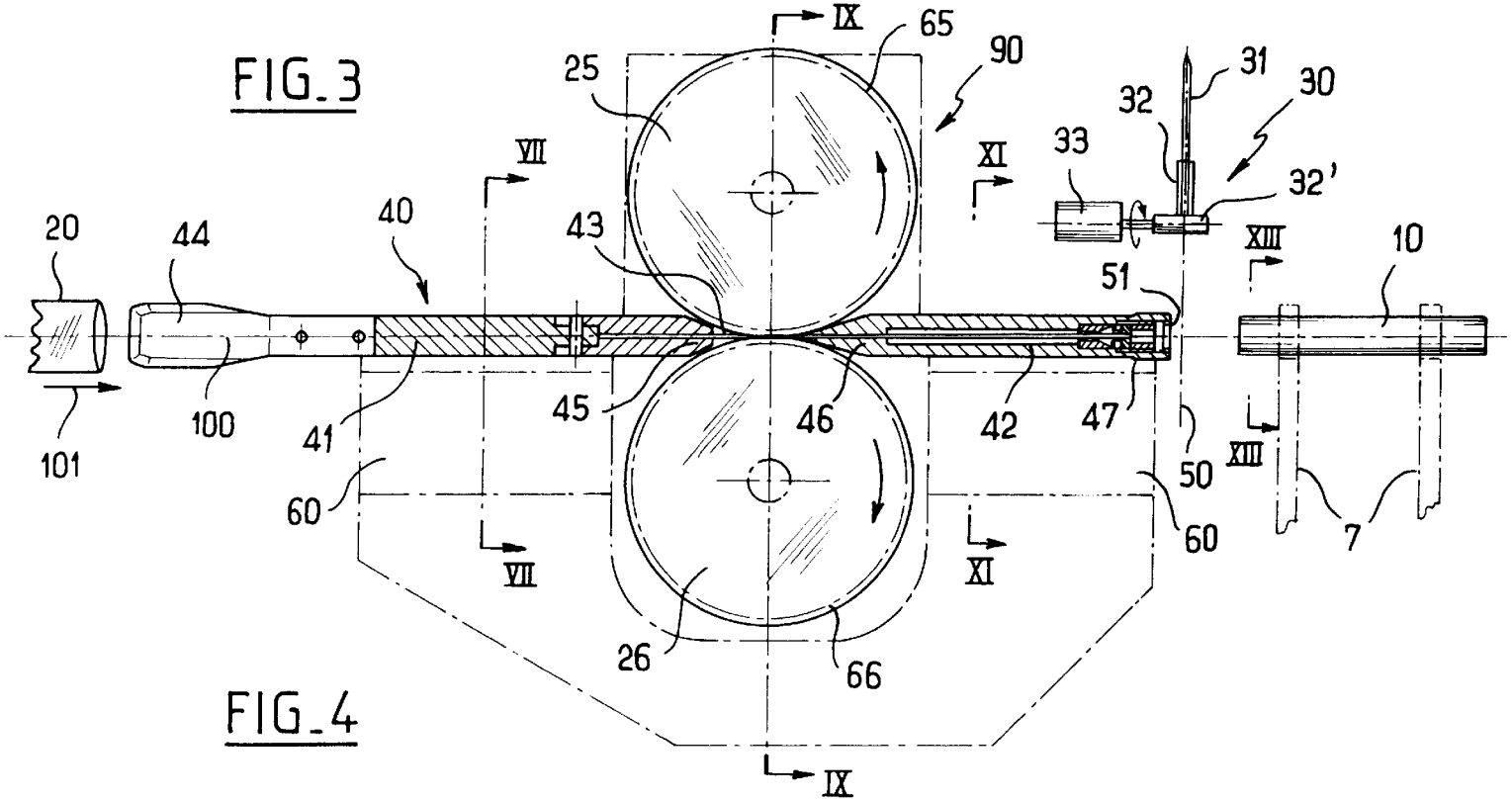
FIG. 3 is an elevation view in greater detail showing the horizontal shaping mandrel made of up two torpedoes and two adjacent pinch wheels disposed on either side of the thread-like element interconnecting the two torpedoes.
Figure 4:
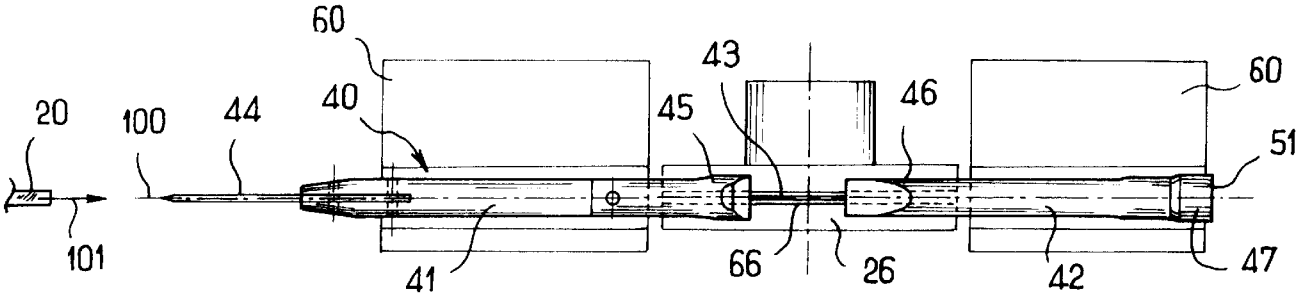
FIG. 4 is a plan view of the assembly shown in FIG. 3.
Figure 5:
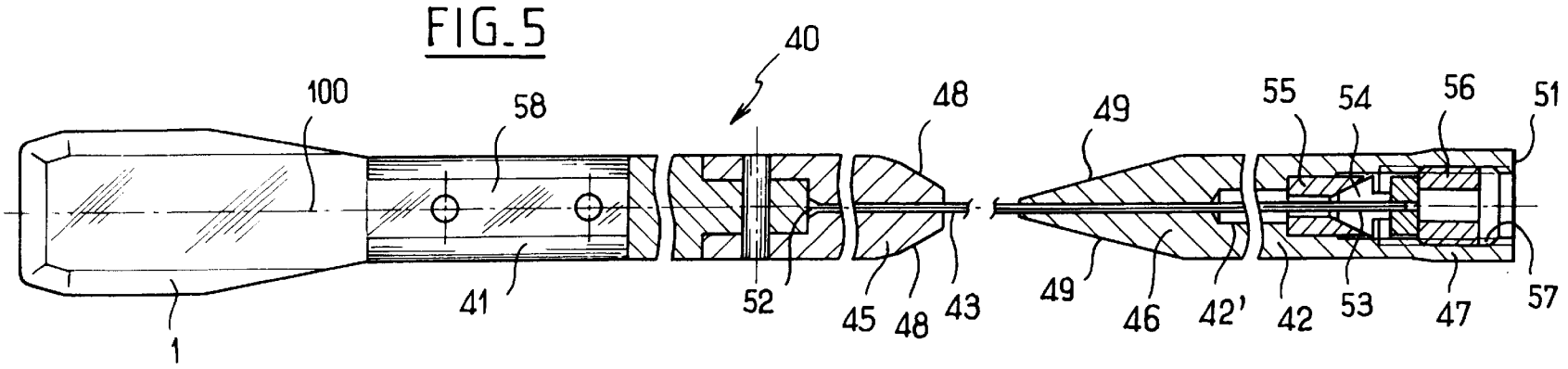
FIG. 5 is an elevation view (partially in section) on a larger scale of the horizontal shaping mandrel.
Figure 6:
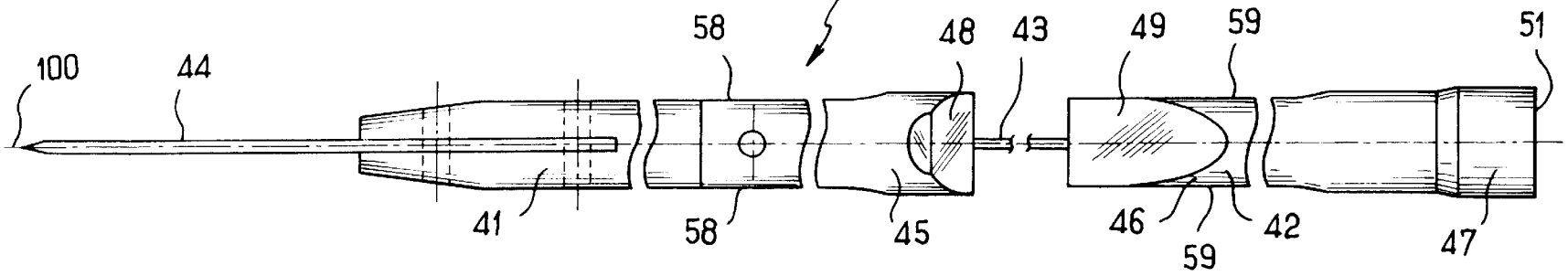
FIG. 6 is a plan view thereof.

Nevertheless, the shaping mandrel 40 of the fitting machine of the invention is organized in a manner that is very particular, as described below. The shaping mandrel 40 is substantially horizontal (with reference to its axis 100) and it comprises two torpedoes 41 and 42 in axial alignment and interconnected by a thread-like central element 43. Thus, there is an upstream torpedo 41 having an upstream end 44 that forms an insertion spatula and a downstream end 45 having a pair of smooth chamfers (i.e. it has no bearing wheels), and a downstream torpedo 42 having an upstream end 46 with a pair of smooth chamfers (i.e. it has no bearing wheels), and a downstream end 47 having a straight edge 51 adjacent to the cutter means 30. The terms "upstream" and "downstream" are used herein relative to the travel direction of the sheath, which is represented in FIGS. 3 and 4 by an arrow 101.

The thread-like element 43 may be constituted by a flexible steel wire having a diameter of about 1 mm, for example, and it has its two ends 52 and 53 secured in the two torpedoes 41 and 42, respectively. The end 52 has an end toggle which enables it to be held in abutment by natural wedging, while the end 53 is fixed via releasable anchor means. One such releasable anchor system can be seen in particular in FIG. 5 which makes use of a clamping jaw 54 having a conical outside surface bearing against an abutment cone 55, together with a clamping bushing 56 engaged in an associated open tapped end 57 of the downstream torpedo 42. Tightening the bushing 56 into the associated thread 57 serves to urge the clamping jaw 54 against the abutment cone 55, thereby securing the end 53 of the thread-like element 43. By releasing the bushing 56, it is possible to slide the steel wire through the anchor elements and thus to adjust the position of the wire relative to the downstream torpedo 42. This adjustment option is advantageous in practice since it enables the length of the thread-like element 43 between the horizontal torpedoes 41 and 42 to be adjusted. This adjustment is important insofar as the pinch wheels 25 and 26 are received accurately between the facing ends of the torpedoes 41 and 42 while passing over the thread-like element 43.

Figure 16:
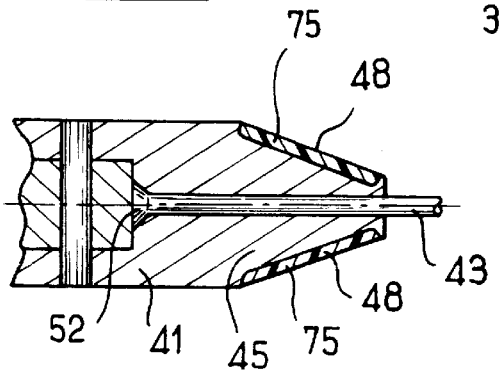
FIG. 16 is a detail view showing a variant in which the downstream end of the upstream torpedo has a smooth double chamfer defined by two inserts.

The downstream end 45 of the upstream torpedo 41 and the upstream end 46 of the downstream torpedo 42 are shaped so as to have respective pairs of smooth chamfers. These pairs of chamfers referenced 48 and 49 for the upstream and downstream torpedoes 41 and 42 are constituted by sloping plane facets arranged symmetrically about a midplane containing the thread-like element 43, and tangentially to the wheels 25 and 26. As can be seen more clearly in FIG. 5, the pairs of smooth chamfers 48 of the upstream torpedo comprise two sloping plane facets, e.g. sloping at an angle of about 30°, and the two pinch wheels 25 and 26 pass tangentially over said pairs of smooth chamfers. Given the large amounts of friction that exist at the pair of smooth chamfers 48 of the upstream torpedo 41, provision can be made for said pair of chamfers 48 to be defined by fitted inserts. The detail of FIG. 16 shows such a variant and shows the end 45 of the upstream torpedo 41 fitted with small plates 75 which are preferably interchangeable, having free faces that constitute the sloping plane facets that co-operate with the pinch wheels 25 and 26. These small plates 75 can be made of any suitable material, for example a plastics material or a ceramic. Surface state at the pairs of smooth chamfers 48 is thus fully under control. The pair of smooth chamfers 49 of the downstream torpedo is formed by two facets that slope at a shallower angle.

In order to transfer the sheath horizontally (the shaping mandrel always remains substantially horizontal), each torpedo 41, 42 of the shaping mandrel 40 rests freely on an associated V-support 60, with the two drive wheels 25 and 26 being arranged between the two V-supports. The section of FIG. 7 and the detail of FIG. 8 show one of these supports 60 more clearly, together with its V-shaped facets referenced 60.1 that serve to ensure that the torpedoes are properly centered on their axis. In this case, the supports 60 are associated with a top abutment 61 that prevents the torpedo 41 from being raised. It will also be observed that there is a longitudinal slot 60.2 in the bottom of the V-groove of each support 60. This slot makes it easier to pass the bottom crease of the sheath along the bottom of the groove, and considerably reduces friction, thereby making it easier to pull the sheath along without running any risk of crumpling it.

Figure 7:
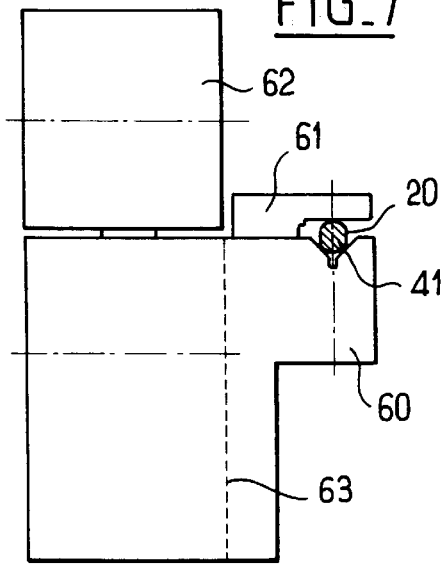
FIG. 7 is a section view on VII—VII of FIG. 3.
Figure 8:
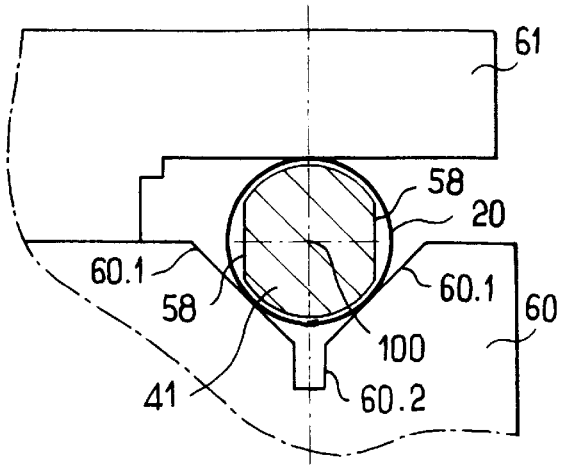
FIG. 8 is a fragmentary view on a larger scale showing the horizontal shaping mandrel over which the sheath passes.

FIGS. 7 and 8 also show the presence of two plane side facets 58 on the torpedo 41, which facets are substantially perpendicular to the plane in which the continuous sheath is pinched between the two wheels 25 and 26. These plane side facets 58 make it possible to avoid excessive pressure from the sides of the sheath, and this is particularly advantageous when the sheath is coated on its inside face in a special varnish or the like.

On passing over the insertion spatula 44, the sheath 20 is flat, however it is expanded progressively as it passes onto the main portion of the upstream torpedo 41 whose section is substantially circular. Although not shown in FIGS. 7 and 8, the sheath will in practice present a small crease along the top and the bottom of the sheath as a result of its initial flat shape.

Figure 9:
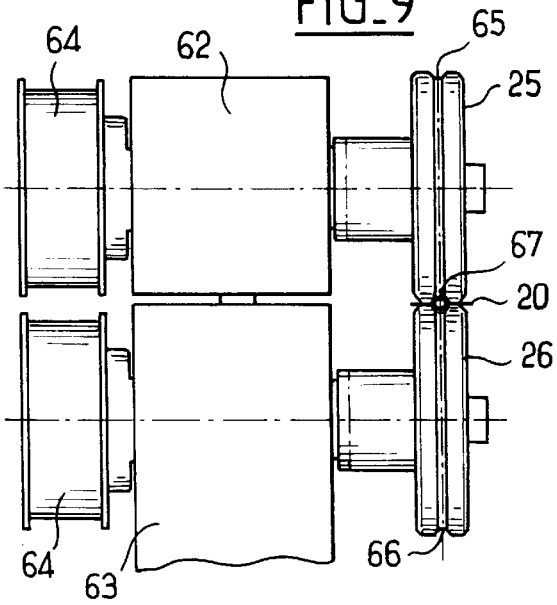
FIG. 9 is a section view on IX—IX of FIG. 3.
Figure 10:
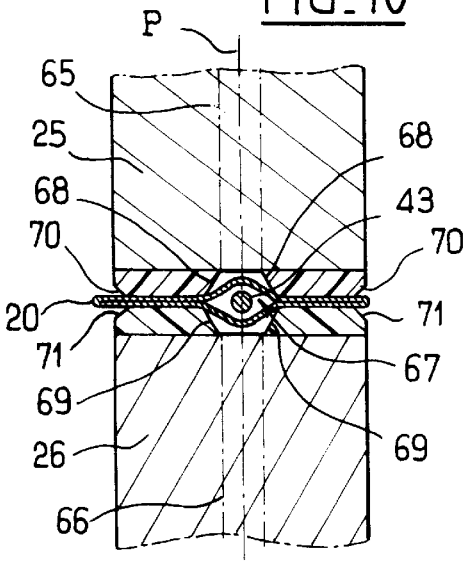
FIG. 10 is a fragmentary view on a larger scale showing more clearly the horizontal-axis passage defined between the two adjacent pinch wheels.
Figure 11:
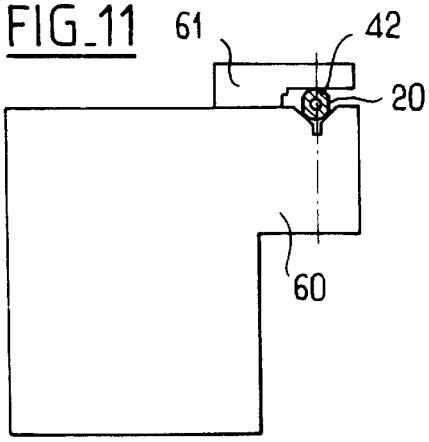
FIG. 11 is a section on XI—XI of FIG. 3.
Figure 12:
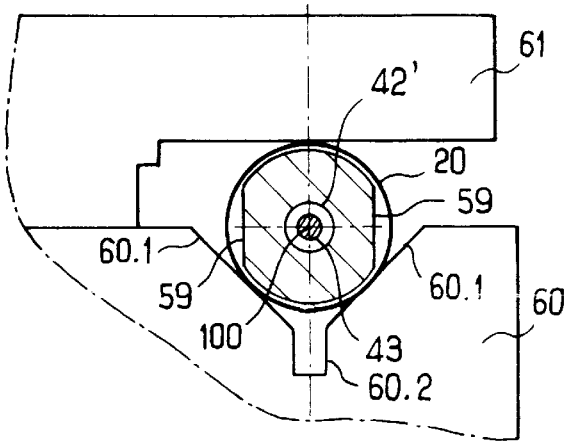
FIG. 12 is a detail section on a larger scale analogous to that of FIG. 8.

As can be seen more clearly in FIGS. 9 and 10, the two adjacent pinch wheels 25 and 26 are disposed symmetrically on either side of the thread-like element 43 of the horizontal shaping mandrel 40, and each wheel 25, 26 has a peripheral groove 65, 66 that is complementary to that of the other wheel 26, 25 so as to form a horizontal-axis passage 67 for said thread-like element. As can be seen in FIG. 3, the adjacent pinch wheels 25 and 26 also pass close to the smooth chamfers of the torpedoes 41 and 42, i.e. the sloping plane facets 48 of the upstream torpedo 41 and 49 of the downstream torpedo 42. The sheath 20 passing over the upstream torpedo 41 and reaching the pair of smooth chamfers 48 is then pinched by the two rollers 25, 26 which flatten the sheath onto the thread-like element 43 while also transferring it horizontally, and the sheath is not jammed in any way on said thread-like element, because of the presence of the peripheral grooves 65 and 66 which define the passage 67. In FIG. 9, there can also be seen the housings 62 and 63 that carry the wheels 25 and 26, and at the other ends of said housings, the pulleys 64 over which the above-mentioned transmission belt 27 passes to drive rotation of the wheels 25 and 26.

The arrangement of the wheels 25 and 26 is shown in greater detail in FIG. 10.

In this figure, it can be seen that the wheels 25 and 26 are in contact with each other on either side of their peripheral grooves 65 and 66. In practice, the peripheries of these two pinch wheels 25 and 26 are coated in an elastomer, e.g. a polyurethane of suitable hardness. The peripheral groove 65, 66 of at least one of the two pinch wheels 25, 26 (and in particular the grooves of both of them) can be of trapezoidal shape as shown in FIG. 10 (naturally in a variant a different shape could be provided, in particular a conventional V-shape). The two grooves 65 and 66 then have two sloping facets 68 and 69 inclined symmetrically about the midplane of the two wheels 25, 26, referenced P, thereby forming a V-shape opening at an angle of about 60°. These facets 68 and 69 contribute to overall guidance and prevent the traveling sheath being offset sideways as it passes over the thread-like element 43. It should also be observed that chamfers 70 and 71 are present on the outside edges of the wheels 25 and 26. These chamfers 70 and 71 avoid excessive compression being applied to the sheath 20 since that would create a crease in the vicinity of the edges of said sheath and the resulting marking would be difficult to eliminate during shrinkage of the sleeve on the object. The thread-like element 43 remains in position in the midplane P because the upstream and downstream torpedoes 41 and 42 that form the horizontal shaping mandrel 40 are both positioned correctly.

Downstream from the pair of wheels 25, 26, the sheath 20 passes over the downstream torpedo 42, and the free edge of said sheath comes level with the free edge 51 of said torpedo, and in this case said edge forms a right circle. FIGS.

11 and 12 show the plane side facets 59 that are also provided on the downstream torpedo 42 to avoid excessive friction, in the same manner as the facets 58 on the upstream torpedo 41. Although not visible in FIG. 12, the sheath which passes horizontally between the supports 60 and 61 and the downstream torpedo 42 does in fact have a small amount of creasing along four edges so as to give it a section in the form of an ace-of-diamonds. The top and bottom creases correspond to the sheath passing over the insertion spatula 44, while the two side creases correspond to the sheath passing between the two adjacent pinch wheels 25 and 26.

It is advantageous for the sheath 20 to have a section with an ace-of-diamonds shape insofar as the resulting quadrilateral fits neatly on the section of the object 10 that is to be covered and can slide lightly along said object. This is favorable for obtaining very accurate axial and transverse positioning of the sleeve on the object. In addition, when the object fitted with its sleeve comes into the shrinking tunnel, shrinkage is limited, insofar as the sheath is tangential to the object to be covered in four different side zones, so shrinkage takes place mainly at the four lightly-marked creases.

The circular shape of the outlet section of the downstream torpedo 42 is merely an example, and other special shapes could be provided (e.g. square, lozenge-shaped, or elliptical) as a function of the shape of the corresponding object, so as to preform the sheath that leaves the shaping means in a manner that is entirely suited to the section of the object. This facilitates accurate positioning and makes high rates of throughput possible when fitting sleeves, which rates can exceed 200 sleeves fitted per minute.

In FIG. 3, there can also be seen cutter means 30 constituted by a blade 31 mounted on an arm 32 that rotates about a horizontal axis 32', under drive from an associated motor 33. In practice, the plane referenced 50 in which the rotary blade 31 moves is immediately adjacent to the straight edge 51 of the downstream torpedo 42, thereby contributing to cutting the sheath accurately and without creasing during the cutting stage. Naturally, it is also possible to provide guillotine-type cutter means, but tests performed by the Applicant have shown that a rotary blade gives excellent results in obtaining a cut that is entirely clean, and in addition provides the option of a special arrangement that is described below in greater detail with reference to FIG. 15.

Figure 13:
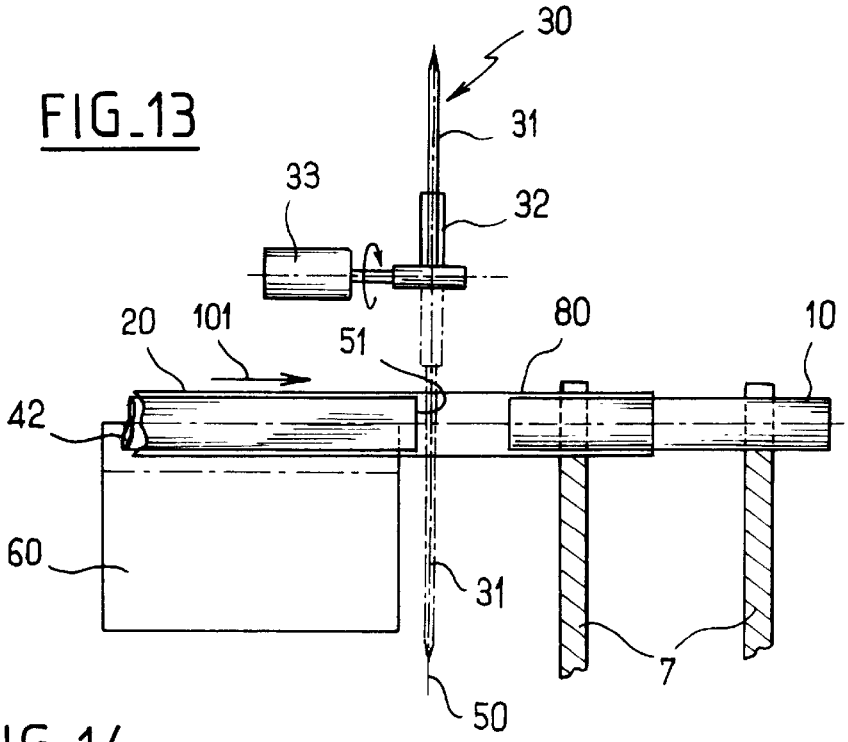
FIG. 13 is a detail view showing how the advance of the sheath over an object is stopped immediately before the sheath is cut.
Figure 14:
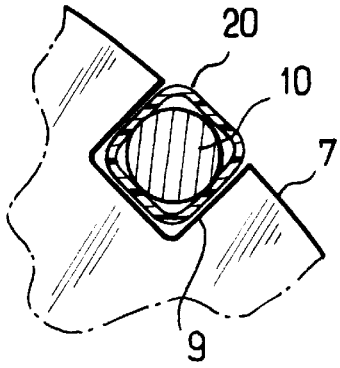
FIG. 14 is a detail view showing an object in a slot of a dual sprocket-wheel, fitted with a segment of sheath whose section is ace-of-diamonds shaped.

As can be seen in FIG. 13, the continuous sheath 20 passes beyond the straight edge 51 of the downstream torpedo 52 so as to engage on an object 10 that is to be covered, with this taking place over a length that is predetermined in advance (and may be as long as the full length of the object). Once this advance has been reached, the drive to the motor-driven wheels 25 and 26 is stopped and cutting takes place in the cutting plane 50. The detail of FIG. 14 shows clearly the element 10 received in a slot 9 of the dual sprocket-wheel 7, and covered in the sheath 20 with an ace-of-diamonds shaped section. Once cutting has taken place, the segment of sheath removed in this way forms a sleeve 80 which is subsequently to be shrunk onto the object 10 in the shrinking tunnel 17 of the fitting machine.

A preferred embodiment is described below for the cutter means 30 with reference to FIG. 15.

Figure 15:
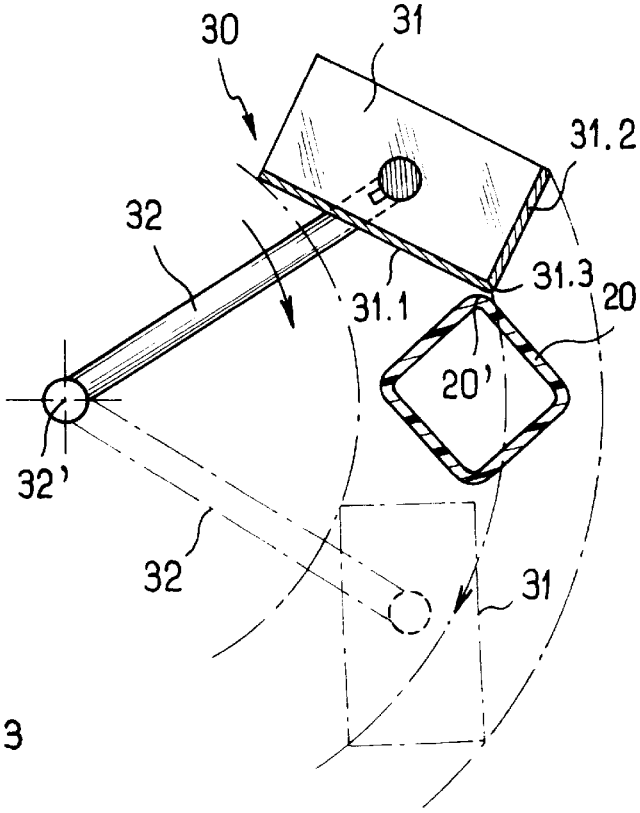
FIG. 15 is a detail view showing a preferred embodiment of the means for cutting the sheath.

In FIG. 15, there can be seen the cutter means 30 having a blade 31 carried by a rotary arm 32 on a horizontal axis 32' parallel to the axis of the torpedoes 41 and 42, said means preferably being positioned in such a manner that its blade 31 is flush with the straight edge 51 of the downstream end 47 of the downstream torpedo 42, as described above. Specifically, the cutter blade 31 has two rectilinear cutting edges referenced 31.1 and 31.2 which meet at a leading edge referenced 31.3. The two cutting edges 31.1 and 31.2 are preferably substantially perpendicular to each other and are arranged so that the leading edge 31.3 makes contact with a top edge of the sheath 20 in the vicinity of a crease line thereof that results from said sheath passing over the insertion spatula 44 or between the two pinch wheels 25 and 26. Specifically, there is shown an arrangement in which the two cutting edges 31.1 and 31.2 meet a top crease 20' of the sheath 20, however it would be entirely possible for the engagement to take place at some other crease. This arrangement of the cutting edges and of the leading edge of the blade 31 makes it possible to cut the sheath 20 in extremely satisfactory manner because of the percussion mass effect exerted on the crease line 20', which is immediately followed by the top left corner of the sheath being cut by the edge 31.1 of the blade and simultaneously the right top edge and then the right bottom edge are progressively engaged by the cutting edge 31.2. This dual and progressive cutting takes place without creasing, with a shear effect that is extremely favorable to obtaining a clean cut through the wall of the sheath.

A machine is thus provided for fitting heat-shrink sleeves that is entirely suitable for transferring and fitting sleeves of small diameter, e.g. sleeves of diameter lying in the range 5 mm to 20 mm, and enabling this to be done at rates of throughput that can be well in excess of 200 sleeves per minute. The sleeve is transferred horizontally in a manner that is under full control and the sleeve is not pinched excessively, so unfavorable phenomena of overheating or wear do not arise.

The invention is not limited to the embodiments described above, but on the contrary covers any variant reproducing the essential characteristics specified above by equivalent means.

What is claimed is:

1. A machine (1) for fitting sleeves of heat-shrink plastics material on objects (10), the sleeves being taken from a continuous sheath (20) that is rolled up flat, the machine including a shaping mandrel (40) over which the sheath passes to be expanded, sheath drive means (10) using motor-driven wheels which co-operate with an associated portion of the shaping mandrel to engage an open end of the sheath on an object, and cutter means (30) intervening between the shaping mandrel (40) and the object (10) so as to form a sleeve (80) associated with said object, wherein the shaping mandrel (40) is substantially horizontal and comprises two torpedoes (41, 42) in axial alignment interconnected by a flexible wire (43) anchored at both ends (52, 53) in said torpedoes, one of the anchored ends of the flexible wire (43) being releasable so as to enable the length of said flexible wire between said torpedoes to be adjusted, said flexible wire being formed of a steel wire having a diameter of about 1 mm, with an upstream torpedo (41) having an upstream end forming an insertion spatula (44) and a downstream end (45) with a pair of smooth chamfers, and a downstream torpedo (42) presenting an upstream end (46) with a pair of smooth chamfers and a downstream end (47) with a straight edge (51) adjacent to the cutter means (30), each torpedo (41, 42) of said mandrel resting freely in an associated V-support (60), and the sheath drive means (90) comprises, between the two V-supports (60), two adjacent pinch wheels (25, 26) disposed symmetrically on either side of the flexible wire (43) of the shaping mandrel (40) and passing in the vicinity of the chamfered smooth edges of the torpedoes (41, 42), each wheel (25, 26) having a peripheral groove (65, 66) complementary to that of the other wheel (26, 25) so as to form a horizontal axis passage (67) for said flexible wire.

2. A sleeve-fitting machine according to claim 1, wherein the insertion spatula (44) of the upstream torpedo (41) extends in a plane which is substantially perpendicular to a plane in which the continuous sheath is pinched between the two wheels (25, 26).

3. A sleeve-fitting machine according to claim 2, wherein the upstream torpedo (41) and/or the downstream torpedo (42) has two plane side facets (58, 59) substantially perpendicular to a plane in which the continuous sheath is pinched between the two wheels (25, 26).

4. A sleeve-fitting machine according to claim 1, wherein the pairs of smooth chamfers (48, 49) of the upstream and downstream torpedoes (41, 42) are formed by sloping plane facets disposed symmetrically about a midplane containing the flexible wire (43) and tangential to the two pinch wheels (25, 26).

5. A machine for fitting sleeves according to claim 4, wherein the pair of smooth chamfers (48) of the upstream torpedo (41) is formed by two plane facets sloping at about 30°, and the two pinch wheels (25, 26) pass tangentially over said pair of smooth chamfers (48), while the pair of smooth chamfers (49) of the downstream torpedo (42) is formed by two plane facets that slope at a smaller angle.

6. A machine for fitting sleeves according to claim 5, wherein the pair of smooth chamfers (48) is defined by two fitted inserts (75), that are preferably interchangeable, having free facets constituting the sloping plane facets that co-operate with the pinch wheels (25, 26).

7. A machine for fitting sleeves according to claim 1, wherein a longitudinal slot (60.2) is provided in the bottom of the V-grooves of each torpedo support (60).

8. A machine for fitting sleeves according to claim 1, wherein the cutter means (30) comprise a, blade (31) carried by a rotary arm (32) on a horizontal axis, and said means is positioned in such a manner that its blade (31) is flush with the straight edge (51) of the downstream end (47) of the downstream torpedo (42).

9. A machine for fitting sleeves according to claim 8, wherein, the cutter blade (31) has two rectilinear cutting edges (31.1, 31.2) that meet at a leading edge (31.3).

10. A machine for fitting sleeves according to claim 9, wherein the two cutting edges (31.1, 31.2) are substantially perpendicular and arranged in such a manner that the leading edge (31.3) meets the top (20') of the sheath in the vicinity of a crease therein that results from said sheath passing over the insertion spatula (44) or between the two pinch wheels (25, 26).

11. A machine for fitting sleeves according to claim 1, wherein the two pinch wheels (25, 26) are peripherally coated in elastomer, and come into contact with each other on either side of their peripheral grooves (65, 66) which are trapezoidally shaped and present two facets (68, 69) sloping symmetrically about their midplane (P), forming a V that opens at an angle of about 60°.

12. A machine for fitting sleeves according to claim 11, wherein the two pinch wheels (25, 26) are chamfered on their outer edges (70, 71).

13. A machine for fitting sleeves according to claim 1, wherein the two pinch wheels (25, 26) are mounted on a carrying structure (23) capable of pivoting, preferably about a vertical axis (19), so as to enable the drive means (90) as a whole to be offset laterally.

* * * * *